United States Patent [19]

Schaumann

[11] Patent Number: 4,591,343

[45] Date of Patent: May 27, 1986

[54] WALKER-SAILOR WATERCRAFT

[76] Inventor: Peter H. Schaumann, 15 Jasmine La., Port St. Lucie, Fla. 33452

[21] Appl. No.: 721,760

[22] Filed: Apr. 10, 1985

[51] Int. Cl.[4] ..... A63C 15/03

[52] U.S. Cl. ..... 441/76; 114/39; 114/90; 114/92; 114/102; 114/165

[58] Field of Search ..... 441/65, 66, 67, 68, 441/69, 70, 72, 73, 74, 75, 76, 77, 79; 280/810, 816, 818; 114/39, 102, 90, 92, 97, 162, 165

[56] References Cited

U.S. PATENT DOCUMENTS

| | | | |
|---|---|---|---|
| 2,940,090 | 6/1960 | Fournier | 441/77 |
| 4,117,562 | 10/1978 | Schaumann | 441/77 |

FOREIGN PATENT DOCUMENTS

| | | | |
|---|---|---|---|
| 807596 | 7/1951 | Fed. Rep. of Germany | 441/73 |
| 1008914 | 5/1952 | France | 441/77 |
| 1569855 | 6/1969 | France | 114/102 |

*Primary Examiner*—Sherman D. Basinger
*Assistant Examiner*—Paul Salmon
*Attorney, Agent, or Firm*—Watson, Cole, Grindle & Watson

[57] ABSTRACT

A walker-sailor watercraft which can be used for either walking or sailing on the surface of a body of water includes separate right and left walker members, each walker member including a foot cavity, a support member, a hollow seat member and a storage member, a sail mounting platform which is fixedly connectable between the support members of the walker members and otherwise storable in the hollow seat member on one of the walker members, a sail structure which is mountable on the sail mounting platform and otherwise storable in the storage members of one of the walker members, and a rudder structure which is mountable on the trailing end of one of the walker members and otherwise storable in the hollow seat member of the other of the walker members.

18 Claims, 11 Drawing Figures

FIG. 3
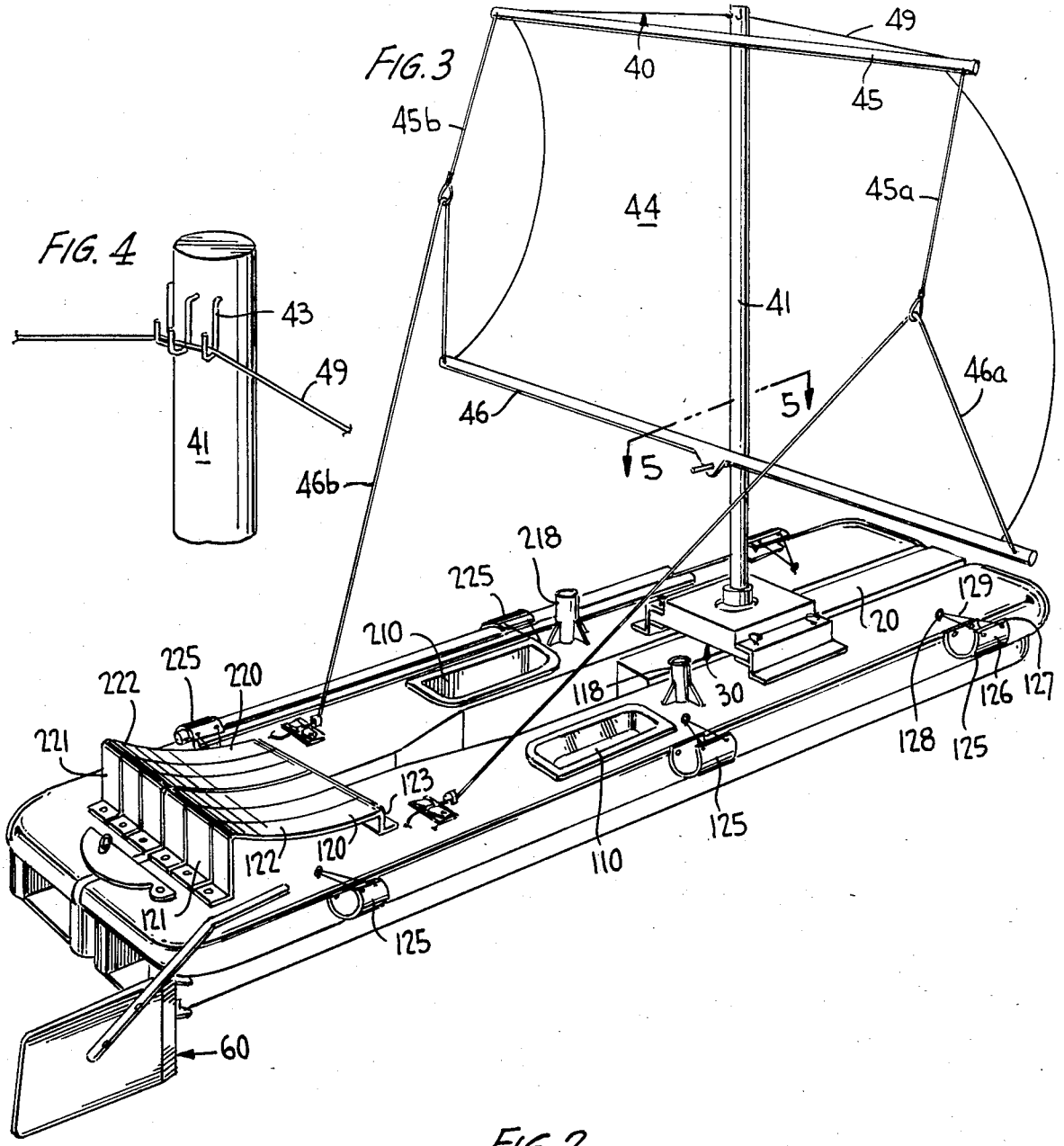
FIG. 4
FIG. 2
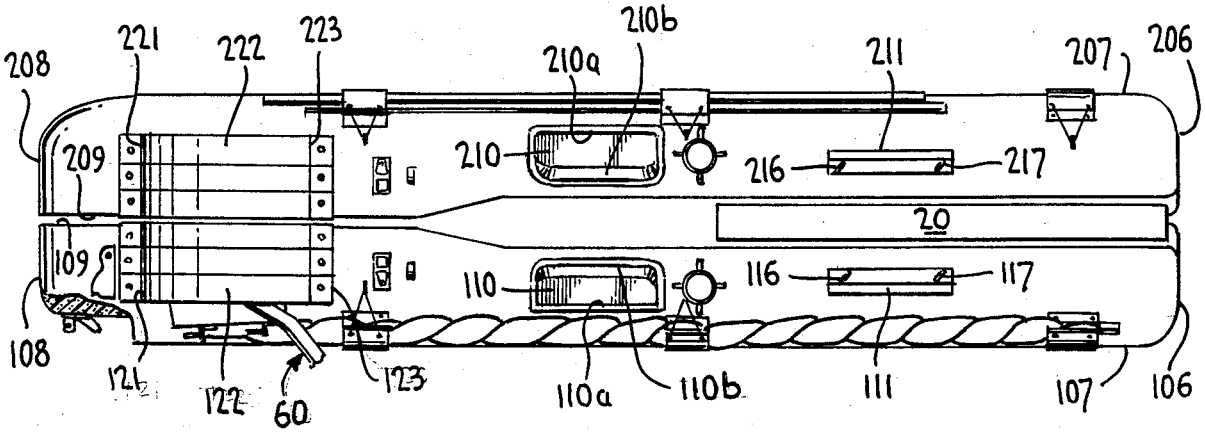

WALKER-SAILOR WATERCRAFT

BACKGROUND OF THE INVENTION

1. Field of the Invention

The present invention relates to water walking assemblies of the type which include separate right and left walker members which can support a user above the surface of a body of water and enable the user to walk thereon.

2. The Prior Art

Water walking assemblies which include separate left and right walker members and which can enable a user to move across the surface of a body of water are well known. Many of these water walking assemblies include means to connect the walker members thereof together so as to provide controlled movements therebetween.

SUMMARY OF THE INVENTION

It is an object of the present invention to provide a water walker assembly which includes right and left walker members that can not only be used for walking on the surface of a body of water but which can also be used for sailing.

According to the present invention a walker-sailor watercraft is provided which includes right and left walker members, a sail mounting platform which can be connected between the right and left walker members to fix them together, a sail structure which can be mounted on the sail mounting platform and a rudder structure which can be connected to the trailing end of one of the walker members. Each of the right and left walker members includes a foot cavity, a support member for the sail mounting platform, a hollow seat member and storage means. The sail structure, when not in use, is constructed to be storable in the storage means on either the right or the left walker member, and both the mounting platform and the rudder structure, when not in use, are storable within a respective hollow seat member on either the right or the left walker member. As such, the walker-sailor watercraft can be used either for walking or sailing, depending on whether or not the sail mounting plate, the sail structure and the rudder structure are assembled for use. The conversion of the walker-sailor watercraft from its walking mode to its sailing mode and vice versa can take place either on land or when the watercraft is floating offshore.

A further understanding of the invention will now be achieved by reference to the accompanying drawings, taken in conjunction with the following explanation.

DESCRIPTION OF THE DRAWINGS

In the drawings,

FIG. 2 shows a partially broken away plan view of the walker-sailor watercraft shown in FIG. 1, FIG. 3 shows a perspective view of the walker-sailor watercraft shown in FIG. 1 when assembled for use in sailing on a body of water, FIG. 4 shows a perspective view of a first detail of the walker-sailor watercraft as shown in FIG. 3, in particular a detail of its sail structure.

DETAILED DESCRIPTION OF THE PREFERRED EMBODIMENT

Figure 1:
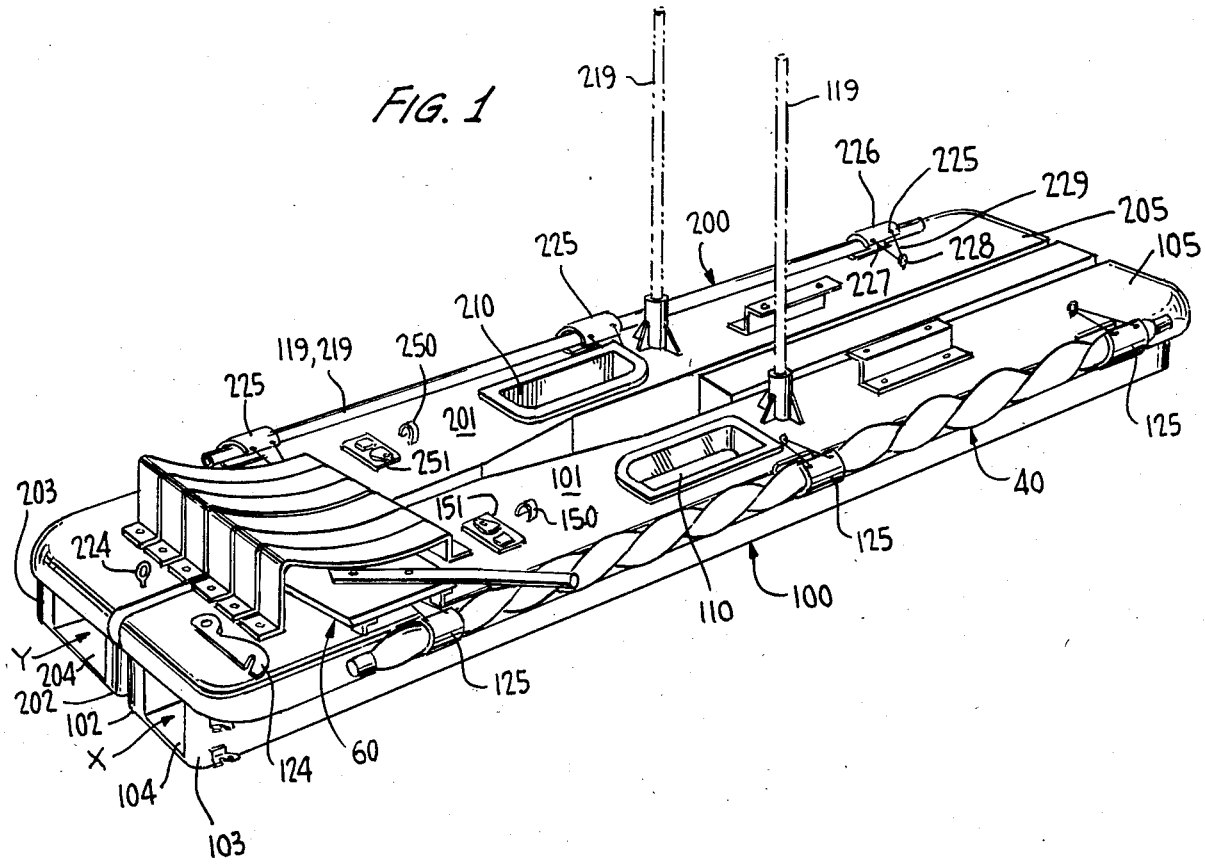
FIG. 1 shows a perspective view of a preferred embodiment of a walker-sailor watercraft according to the present invention, the watercraft being shown assembled for use in walking on the surface of a body of water.

A preferred embodiment of the inventive walker-sailor watercraft is shown in FIGS. 1–11, the watercraft being shown in FIG. 1 when assembled in a walking mode and in FIG. 3 when assembled in a sailing mode. As most fully seen in FIG. 3, the walker-sailor watercraft includes a buoyant right walker member 100, a buoyant left walker member 200, a stabilizer cartridge 20, a sail mounting platform 30, a square-rig sail structure 40 and a rudder structure 60. Each of these parts of the walker-sailor watercraft is used when the watercraft is used for sailing (FIG. 3); however, the sail mounting platform 30, the sail structure 40 and the rudder structure 60 are not used when the watercraft is used for walking (FIG. 1), but are instead suitably stored on the walker members.

In the following description of the various parts of the inventive walker-sailor watercraft the terms vertical, horizontal, upper and lower will be used on the assumption that the watercraft is stationarily floating on the surface of a calm body of water, and the terms right, left, inner, outer, front, rear, leading and trailing, except when referring to the keels of the water members, will be used as they would apply to a user standing on the watercraft and about to use it in a walking mode. When referring to the keel surfaces, the terms inner and outer will refer to whether or not these surfaces face the water flow channels formed therebetween.

The right and left walker members 100,200, which are in many respects mirror images of one another, each includes an elongated upper body 101,201, inner and outer elongated keels 102,103 and 202,203, and a lower plate 104,204 (see FIG. 1). Each upper body can, for example, be about 4 inches thick, and the keels can, for example, be about 3 inches thick and 12 inches high. Each upper body 101,201 defines a top surface 105,205, a bottom surface (not labeled), a leading end 106,206, an outer side 107,207, a trailing end 108,208 and an inner side 109,209 (see FIG. 2). Each top surface slopes downwardly as it extends towards each of its associated leading end, its associated outer side, its associated trailing end and its associated inner side. At the same time, each outer side merges with its associated leading and trailing ends along a curved line. The inner keel of each walker member extends downwardly from the bottom surface of its associated upper body along its inner side, while the outer keel of each walker member extends downwardly from the bottom surface of its associated upper body inwardly of its outer side, such that the associated upper body provides a ledge extending outwardly thereabove. This ledge can extend a maximum of, for example, about 6 inches outwardly of the outer keel. The lower plate 104,204 of each walker member extends between the associated keel pairs 102,103 and 202,203 to form water flow channels X,Y beneath their associated upper bodies. The water in these water flow channels provides a ballast to the respective walker members. Spring-biased gate elements, such as those shown in my U.S. Pat. No. 3,936,897 (the contents of which is incorporated herein by reference) can be advantageously located across each of the water flow channels, X,Y to enhance the operation of the walker members 100,200 when used for walking. The inner surfaces (not labeled) of the keel pairs 102,103 and 202,203 which face the water flow channels X,Y are generally flat along their length. Their associated outer surfaces (not labeled) are generally flat along most of their length, but are curved at their leading and trailing ends toward their associated inner surfaces.

Extending downwardly from the top surface of the upper body of each walker member at a location about halfway along its length is a foot cavity 110,210. Each foot cavity has an outer side wall **110*a*,210*a* (see FIG. 2) which is generally flat and vertically oriented and an inner side wall 110*b*,210*b*** which is bowed, thus providing extra room for the ankles of a person using the walker members for walking on the surface of a body of water.

Although not shown in the drawings, the inner sides of the upper bodies of the walker members, together with their inner keels 102,202, provide indented steps which extend from their leading ends to corresponding locations behind their foot cavities and in each indented step are positioned three guide elements, i.e., as disclosed in by U.S. Pat. No. 4,459,118 (the contents of which is herein incorporated by reference). These guide elements cooperate with the stabilizer cartridge 20, which is constructed in accordance with the disclosure in U.S. Pat. No. 4,459,118, to prevent the walker members from spreading apart or becoming vertically separated when used for walking, yet will allow them, when desired, to be disconnected from one another in order to change direction.

Figure 7:
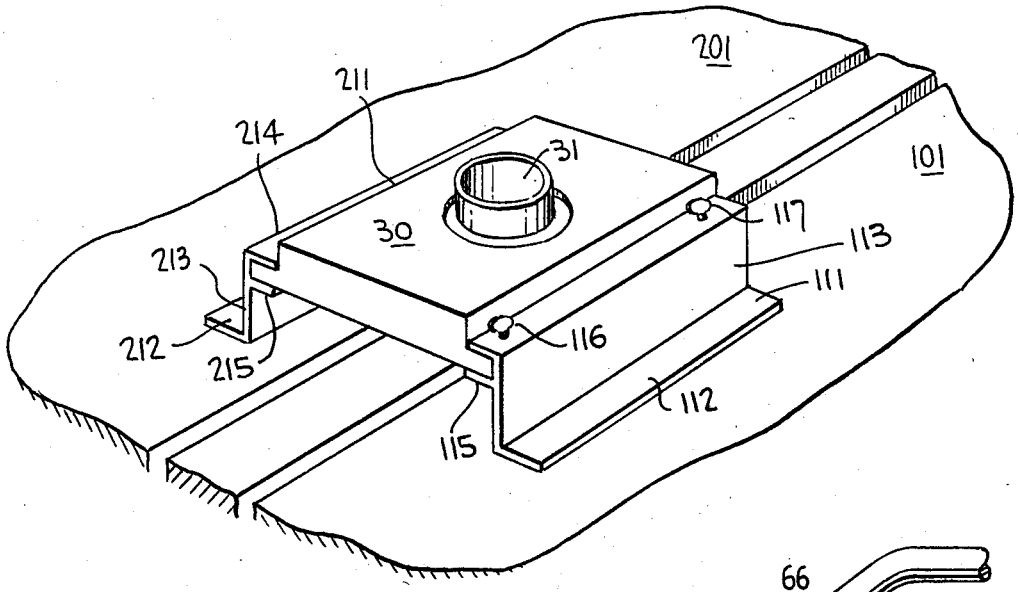
FIG. 7 shows a perspective view of a second detail of the walker-sailor watercraft as shown in FIG. 3, in particular a detail showing its sail mounting platform, FIGS. 8 and 9 respectively show partial side and plan views of the water-sailor watercraft as shown in FIG. 3, in particular showing partial views of the trailing end of its right walker member and its rudder structure.
Figure 5:
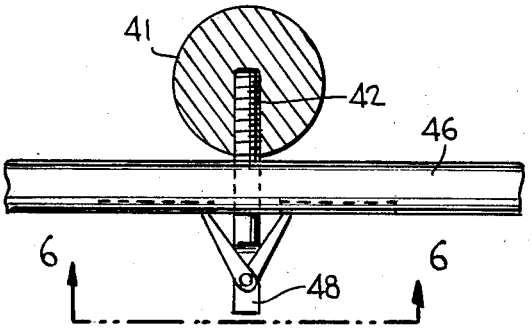
FIG. 5 shows a sectional view of the sail structure of the walker-sailor watercraft as seen along line 5—5 in FIG. 3.

Each of the walker members also includes a support member 111,211 connected to the top surface of its upper body at a point between its foot cavity and its leading end. Each support member includes a base element 112,212 connected to the associated top surface and a vertically-extending F-shaped element 113,213 which faces inwardly of the walker member and which includes upper and lower horizontal flanges 114,115 and 214,215. Two locking screws 116,117 and 216,217 extend downwardly through the upper horizontal flanges. The lower horizontal flanges 115,215 have corresponding openings therein (not shown). As shown in FIGS. 3 and 7, when the sail mounting platform 30 is in use, its lateral sides (which include holes (not shown) through which the locking screws 116,117 and 216,217 can be positioned) will fit between the upper and lower horizontal flanges 114,115 and 214,215 and will be locked in place by the locking screws 116,117 and 216,217. The mounting platform 30 includes a tubular receptacle 31 in the middle of its upper surface in which the lower end of a mast can be removably positioned.

Each of the walker members also includes a socket element 118,218 connected to the top surface of its upper body at a location between its foot cavity and its support member, as well as associated push poles 119,219 (in FIG. 1 the push poles are shown operatively mounted in the socket elements in phantom and inoperatively stored on the left walker member in solid lines). The socket elements and push poles are constructed and used as described in my copending U.S. application Ser. No. 628,906, filed July 9, 1984 now U.S. Pat. No. 4,541,809 (the contents of which is hereby incorporated by reference).

A hollow seat member 120,220 is connected to the top surface of the upper body of each walker member adjacent its inner side and at a location between its foot cavity and its trailing end. Each seat member comprises three elements which have been contoured to include a generally vertical rear wall 121,221, a top wall 122,222 and a generally vertical front wall 123,223. Each rear wall is somewhat higher than its associated front wall, and each top wall 122,222 is concavely curved so as to provide a comfortable seat portion for a person sitting thereon. The space positioned with the three elements of each seat member can be used to store the mounting platform 30 and the rudder structure 60 (see FIG. 1) when these parts of the walker-sailor watercraft are not being used.

Rotatably connected to the top surface of the upper body of the right walker member 100 at a location behind the seat member 120 is a latch element 124 which is sufficiently elongated that it can extend beyond the inner side 109 of the upper body 101. Fixedly extending upwardly from the top surface of the upper body of the left walker member 200 at a location behind the seat member 220 is a post element in the form of a screw eye 224. When the walker-sailor watercraft is to be used in a sailing mode, the latch element 124 can be rotated into engagement with the screw eye 224 to lock the trailing ends of the walker members 100,200 together (see FIG. 3). When the walker-sailor watercraft is to be used in a walking mode, the latch element 124 can be rotated out of engagement with the screw eye 224 to allow free longitudinal movement between the right and left walker members (see FIG. 1).

Each walker member 100,200 also includes three spaced apart storage assemblies 125,225. Each storage assembly 125,225 includes an inwardly-open tube section 126,226 which is connected along its inner edge to the top surface of the associated upper body along the portion thereof which slopes downwardly to its associated outer side, each tube section including two eyes 127,227 along its outer edge; a screw eye 128,228 connected to the top surface of the upper body inwardly of the tube section; and a line 129,229 which is connectable through and between the screw eye 128,228 and the eyes 127,227 of the associated tube sections 126,226. The three storage assemblies of one walker member can be used to store the push poles 119,219 when not in use (see the left walker member in FIGS. 1, 2 and 3), while the three storage assemblies of the other walker member can be used to store the square-rig sail structure 40 when not in use (see the right walker member in FIG. 1).

As best seen in FIG. 3, the square-rig sail structure 40 includes a mast 41, a generally square sail 44, a spreader bar 45, a boom 46, a support cable 49, and control lines **45*a*,45*b*, 46*a* and 46*b*. The sail 44 is connected along its upper side to the spreader bar 45 and along its lower side to the boom 46. The mast 41 has a lower end which is firmly positionable in the tubular receptacle 31 in the sail mounting platform 30 and a threaded bore 42 therein above its lower end, and it supports a plurality of hooks 43 near its upper end (see FIG. 4). The hooks 43 are used to support the support cable 49, which in turn is connected to the spreader bar 45 near its opposite ends. The boom 46 includes a lip 47 halfway along its length through which extends a toggle bolt 48. When the sail structure is to be set up for sailing purposes on the sail mounting platform 30, after the support cable 49 is positioned in the hooks 43 of the mast 41, the lower end of the mast is mounted in the tubular receptacle 31 so as to become vertically positioned thereabove, and the boom 46 is positioned along the mast such that the toggle bolt 48 can be fixedly positioned within the bore 42. The control lines 46***a* and 46*b*, which are connected to the boom 46 near its opposite ends and which extend through loops at the lower ends of control lines 45*a* and 45*b* which are connected to the spreader bar 45 near its opposite ends, can be used to control the movement of the sail 44. If desired, the free ends of the control lines 46*a* and 46*b* that are held by the user of the walker-sailor watercraft can be respectively passed through a fair lead 150,250 and into a jam cleat 151,251 attached to the top surface 105,205 of the upper body 101,201 in front of the seat member 120,220 of the respective walker member.

The rudder structure 60 includes a rudder plate 61 and a tiller bar 66 connected thereto (see FIGS. 3 and 8–10). The tiller bar can comprise a single member or multiple members that can be connected together. The rudder plate 61 includes a generally V-shaped leading edge 62, its inner side 63 mounting two vertically separated support flanges 64. Each support flange 64 includes a downwardly-extending eye hook 65, the head of each eye hook being oriented in parallel with the associated inner side 63 of the V-shaped leading edge 62.

Figure 8:
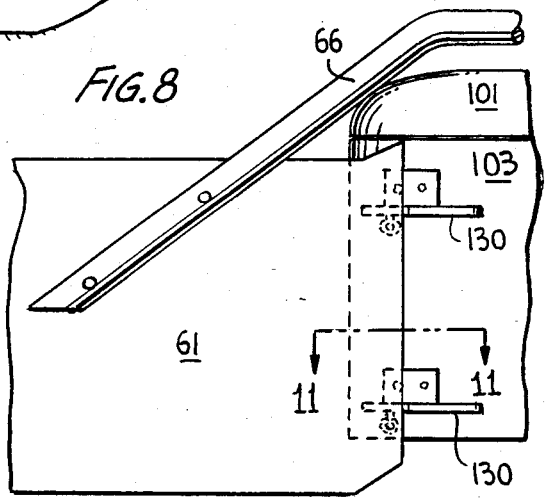
Figure 6:
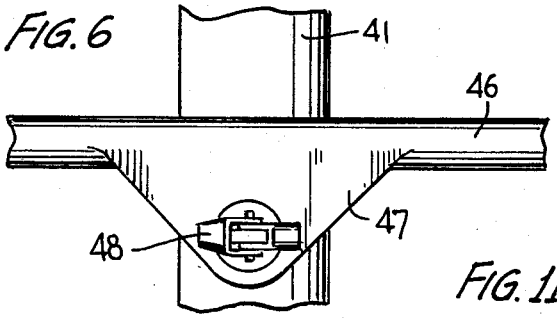
FIG. 6 shows a partial view of the sail structure as seen along line 6—6 in FIG. 5.
Figure 9:
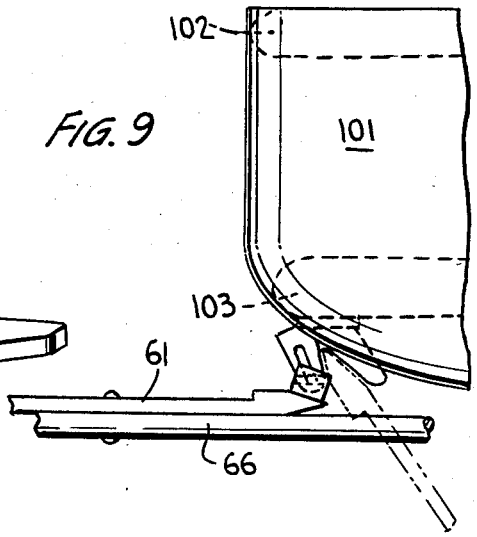
Figure 10:
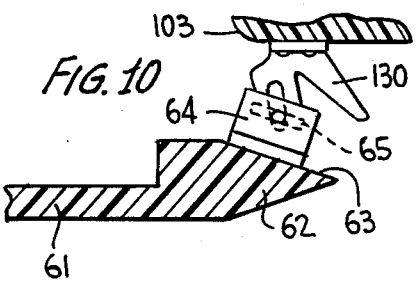
FIG. 10 shows a sectional view of the walker-sailor watercraft as seen along line 10—10 in FIG. 8.
Figure 11:
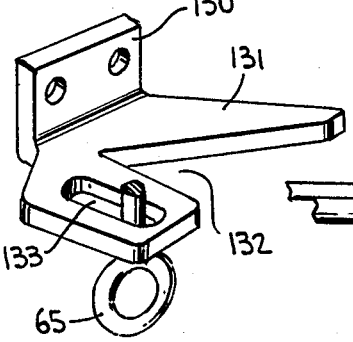
FIG. 11 shows a perspective view of a third detail of the walker-sailor watercraft as shown in FIG. 3, in particular showing one of the mounting brackets that supports the rudder structure on the trailing end of the right walker member.

As can be best seen in FIGS. 1, 8 and 9, the right walker member 100 includes two vertically-separated mounting brackets 130 for mounting the support flanges 64 of the rudder plate 61. These mounting brackets are attached to the trailing end of the outer keel 103 along the portion of the outer surface thereof which curves toward the inner surface thereof. Each mounting bracket includes a horizontal plate 131 which has a portion that projects away from the outer keel 103 a greater distance than does the upper body 101 thereabove (remember: the outer side 107 and the trailing end 108 of the upper body 101 merge along a curve), i.e, so as to be vertically exposed. This exposed portion of the horizontal plate of each mounting bracket includes a generally V-shaped indentation 132 and an elongated slot 133. The elongated slot 133 is located rearwardly of the indentation 132 such that, when the generally V-shaped leading edge 62 of the rudder plate 61 is inserted into and downwardly along the generally V-shaped indentation 132, each eye hook 65 will fit in and through an elongated slot 133 in the associated mounting bracket (see phantom view of rudder plate shown in FIG. 9). Thereafter, the rudder structure can be rotated with respect to the mounting brackets (see FIGS. 9 and 10) for use, yet remain securely supported by the mounting brackets due to the heads of the eye hooks 65 being oriented out of alignment with the elongated slots 133. It should be noted that the mounting brackets 130 do not extend outwardly of the outer keel 103 beyond the maximum distance the upper body 101 extends beyond the outer keel 103.

When both the sail mounting platform 30 and the rudder structure 60 are suitably secured within the seat members 120,220 of the walker members, the sail structure 40 disassembled and stored in the storage assemblies 125,225 of one of the walker members and the latch 125 on the right walker member 100 rotated out of engagement with the post 225 on the left walker member 200, the walker-sailor watercraft can be used for water walking, i.e., as shown in FIG. 1. Push poles 119,219 can be used with the socket elements 118,119 as indicated in FIG. 1. When, however, it is desired to assemble the walker-sailor watercraft for sailing, the latch 125 on the right walker member 100 is swung into engagement with the screw eye 224 on the left walker member 200, the sail mounting platform 30 is removed from within one of the seat members 120,220 and fixedly mounted between the support members 111,211, the sail structure is removed from the storage assemblies 125,225 of one of the walker members and set up for use, and the rudder structure 60 is removed from within one of the seat members 120,220 and operatively mounted on the mounting brackets 130. The walker-sailor watercraft will then be ready for sailing, i.e., as shown in FIG. 3. During this mode of use of the walker-sailor watercraft, the push poles 119,219 will normally be stored in the storage assemblies 125,225 on one of the walker members. It should be noted that the walker-sailor watercraft can be easily reassembled from a walking mode to a sailing mode and vice versa, either while stationarily positioned on land or while floating offshore.

Although a preferred embodiment of the walker-sailor watercraft has now been shown and described in detail, it should be kept in mind that various modifications thereto can be made and still fall within the scope of the present invention. For example, the walker-sailor watercraft need not utilize the stabilizer cartridge 20. In this event, the right and left walker members do not need to have the mentioned intended steps with guide elements along their inner sides. Further, the inventive walker-sailor watercraft need not utilize the socket elements 118,218 with the push poles 119,219. Further, the mast 41 of the sail structure 40 need not have hooks 43 near its upper end for mounting the support cable 49; instead these hooks can be replaced with a single pulley and a rope passing therethrough, the rope being connectable at one end to the support cable 49 and wrappable around a cleat which is attached to the mast 41. On the other hand, when the inventive walker-sailor watercrafted includes the stabilizer cartridge 20, the stabilizer cartridge can include locking fingers mounted thereon and the walker members 100,200 can include ratchet bars (respectively positioned under the lower horizontal flanges 114,214 of the support members 111,211) and release arms as disclosed in my copending U.S. application Ser. No. 628,906, filed July 9, 1984.

I claim:

1. A walker-sailor watercraft which can be assembled for use in a walking mode or for use in a sailing mode, said walker-sailor watercraft comprising (1) right and left walker members, each of said right and left walker members including a buoyant upper body, inner and outer keels extending downwardly from the upper body and a bottom plate extending between the inner and outer keels, each said upper body defining a top surface, a leading end, an outer side, a trailing end and an inner side, and each walker member including a foot cavity extending downwardly from its top surface, a support member connected to its top surface adjacent its inner side at a location between the foot cavity and the leading end, a hollow seat member connected to its top surface at a location between its foot cavity and its trailing end, and storage means connected to its top surface adjacent its outer side, the upper body of one of said right and left walker members including a rotatable latch and the upper body of the other of said right and left walker members including a cooperable post element, the right walker member including at least one mounting bracket attached to the outer keel adjacent to the trailing end of the upper body thereof, (2) a sail mounting platform which is fixedly positionable between the support members of said walker members, said mounting platform including means for mounting the lower end of a mast thereon and otherwise storable within the hollow seat member of one of said right and left walker members, (3) a rudder structure which is removably positionable on the mounting bracket of said right walker member and otherwise storable with the hollow seat member of one of said right and left walker members, and (4) a sail structure which is removably mountable on said sail mounting platform when said sail mounting platform is fixedly positioned between the support members of said walker members and otherwise storable in the storage means on one of said right and left walker members, said sail structure including a mast having a lower end mountable on said mounting platform and an upper end having support means, a boom and a sail.

2. A walker-sailor watercraft as defined in claim 1, wherein said rotatable latch is connected to the top surface of the upper body of one of said right and left walker members between said hollow seat member thereon and its trailing end, and wherein said cooperable post element extends upwardly from the top surface of the upper body of the other of said right and left walker members between said hollow seat member thereon and its trailing end.

3. A walker-sailor watercraft as defined in claim 1, wherein said sail structure includes a spreader bar and a support cable connected between the ends of said spreader bar, said support cable being mountable on said support means at the upper end of said mast, and wherein said sail is generally square and is connected between said boom and said spreader bar.

4. A walker-sailor watercraft as defined in claim 3, wherein said sail structure includes two spreader bar control lines which respectively extend downwardly from the spreader bar near its opposite ends and terminate with loops, and two boom control lines which respectively extend from the boom near its opposite ends, through the loops at the ends of the respective spreader bar control lines, and towards the hollow seat members on the walker members.

5. A walker-sailor watercraft as defined in claim 3, wherein said support means at the upper end of said mast comprises at least one hook.

6. A walker-sailor watercraft as defined in claim 1, wherein said sail mounting platform includes a receptacle in the middle of its upper surface on which said mast is removably positionable.

7. A walker-sailor watercraft as defined in claim 6, wherein the support member connected to the top surface of the upper body of each walker member includes a vertically-extending F-shaped element which faces inwardly of the associated walker member.

8. A walker-sailor watercraft as defined in claim 7, wherein each F-shaped element includes a horizontal upper flange, a horizontal lower flange, and at least two locking screws extending downwardly through said upper horizontal flange and positionable in corresponding holes in said lower horizontal flange.

9. A walker-sailor watercraft as defined in claim 8, wherein said sail mounting platform includes opposite lateral sides having holes through which the locking screws of said support members can pass.

10. A walker-sailor watercraft as defined in claim 1, wherein the hollow seat member connected to the top surface of the upper body of each walker member includes a generally vertical rear wall, a top wall and a generally vertical front wall, the rear wall being higher than its associated front wall and the top wall being concavely curved.

11. A walker-sailor watercraft as defined in claim 1, wherein the storage means connected to the top surface of each walker member adjacent its outer side comprises three spaced apart storage assemblies.

12. A walker-sailor watercraft as defined in claim 11, wherein each storage assembly comprises an upwardly-open tube section being attached along its inner side to the top surface of the associated upper body and including at least one eye means on its outer side, a screw eye connected to the top surface of the associated upper body inwardly of the tube section, and a line connectable between each eye means on the tube section and the screw eye located inwardly thereof.

13. A walker-sailor watercraft as defined in claim 1, wherein said right walker member includes two vertically-separated mounting brackets attached to the outer keel thereof at its trailing end.

14. A walker-sailor watercraft as defined in claim 13, wherein the outer keel of each walker member is connected to the upper body thereof inwardly of its outer edge, such that the upper body forms a ledge extending outwardly thereabove.

15. A walker-sailor watercraft as defined in claim 14, wherein each mounting bracket includes a horizontal plate which includes a portion that extends outwardly of the outer keel to which it is attached a greater distance than the ledge of the upper body thereabove, said portion including a generally V-shaped indentation and an elongated slot rearwardly thereof.

16. A walker-sailor watercraft as defined in claim 15, wherein said rudder structure includes a rudder plate and a tiller bar.

17. A walker-sailor watercraft as defined in claim 16, wherein said rudder structure has a generally V-shaped leading edge which can fit within the V-shaped indentation in the horizontal plate of each said mounting bracket, and wherein said rudder plate also includes two vertically-separated support flanges attached to an inner surface of said V-shaped leading ledge, each support flange having an eye hook extending downwardly therefrom, said eye hooks being oriented in parallel with said inner surface of said V-shaped leading ledge.

18. A walker-sailor watercraft as defined in claim 1, wherein each water member includes a socket element connected to the top surface of the upper body thereof between the foot cavity therein and the support member attached thereto, and wherein said walker-sailor watercraft includes two push poles which are each respectively positionable in a respective socket element and otherwise storable in the storage means on one of said walker members.

* * * * *